US007908680B2

(12) United States Patent
Akitsu

(10) Patent No.: US 7,908,680 B2
(45) Date of Patent: Mar. 22, 2011

(54) DEODORANT CANISTER FOR URINALS THAT ALSO DISPENSES A POTASSIUM PHOSPHATE SCALE INHIBITOR WITH EACH FLUSH

(76) Inventor: Hiromi Akitsu, Kyoto (JP)

( * ) Notice: Subject to any disclaimer, the term of this patent is extended or adjusted under 35 U.S.C. 154(b) by 847 days.

(21) Appl. No.: 11/679,168

(22) Filed: Feb. 26, 2007

(65) Prior Publication Data

US 2009/0165194 A1 Jul. 2, 2009

(51) Int. Cl.
*E03D 9/02* (2006.01)

(52) U.S. Cl. ..... 4/223; 4/231

(58) Field of Classification Search ..... 4/222, 222.1, 4/223, 224, 231

See application file for complete search history.

(56) References Cited

U.S. PATENT DOCUMENTS 1,359,535 A * 11/1920 Runser ..... 4/231
1,815,197 A * 7/1931 Gamel et al. ..... 4/231
1,974,955 A * 9/1934 Foltis ..... 4/231
1,979,755 A * 11/1934 McDermott ..... 4/231
2,214,798 A * 9/1940 Reikosky ..... 4/231
3,736,600 A * 6/1973 Drinkwater ..... 4/231
3,760,429 A * 9/1973 Brownstein ..... 4/222.1
6,817,040 B2 * 11/2004 Klinkhammer et al. ..... 4/231
7,069,602 B1 * 7/2006 Conway et al. ..... 4/231
7,114,199 B2 * 10/2006 Conway et al. ..... 4/231

* cited by examiner

*Primary Examiner* — Tuan N Nguyen
(74) *Attorney, Agent, or Firm* — Angus C. Fox, III

(57) ABSTRACT

A multi-function canister, mountable within a urinal chamber, is held in place by a spring clip that is insertable in one of the flush apertures at the top of the chamber, and which biases the canister against the chamber rear wall. The canister includes an onboard fragrance tablet that continually dispenses an odor-counteracting aroma. The canister also includes a reservoir filled with a solid compound, a dissolved portion of which is released into the chamber with each flush by water flowing from the aperture in which the spring clip is installed. A deflector tray limits the amount of water flowing into the reservoir. The dissolved portion inhibits the formation of potassium phosphate scale (urine calculus) on the surfaces of the urinal chamber and drainage pipes. The solid compound may be sulfamic acid. The canister may also include a grill which covers and protects the fragrance tablet.

17 Claims, 7 Drawing Sheets

DEODORANT CANISTER FOR URINALS THAT ALSO DISPENSES A POTASSIUM PHOSPHATE SCALE INHIBITOR WITH EACH FLUSH

BACKGROUND OF THE INVENTION

1. Field of the Invention

This invention relates to deodorizer dispensers, chemical compounds for interfering with the formation of potassium phosphate, and more particularly, to an apparatus mountable within a urinal that both deodorizes and inhibits the formation of potassium phosphate urine calculus deposits in the urinal and in the drain pipes.

2. Description of the Prior Art

A urinal is a specialized toilet, or plumbing fixture, which receives only liquid body waste discharged almost always by a standing male, and conveys the waste through a trap seal into a gravity drainage system. A urinal is typically smaller and uses much less water than a full-function toilet, and can be installed at a convenient height to accommodate male users having a range of heights. Modern urinals generally are wall-mountable and feature an eliptical open bowl that is continuous with a rear wall of semi-eliptical cross section. Flush water is controllably dispensed through a plurality of flush apertures located in a ceiling of the urinal that is continuous with the rear wall. A drain, which is located at the bottom of the bowl, communicates with a trap that is, in turn, connected to the sewer system.

Potassium phosphate is formed by the reaction of potassium, phosphoric acid and carbon dioxide. As urine typically contains all three compounds, urine calculus deposits, containing a combination of potassium phosphate and organic compounds eliminated by the body, are formed in urinals and in the drain pipes of urinals. As the organic compounds decay, the calculus deposits give off a characteristic foul odor that is present in poorly maintained men's rest rooms. Because urine calculus deposits do not readily dissolve in water, their removal is a challenge for janitorial staffs. After calcium, potassium and phosphorus is the third most abundant element found in the human body. Calcium, potassium and phosphorus are, respectively, the second and third most common elements found in the human body. The presence of potassium is essential for the regulation of the acid-base balance and water balance in the blood and the body tissues, for the synthesis of proteins from amino acids, for carbohydrate metabolism, for the building of muscle tissue, for normal body growth, and for the proper functioning of nerve cells, in the brain and throughout the body. With the proliferation of soft drinks, such as colas, which contain both phosphoric acid and carbon dioxide, these two ingredients are found in urine in increasing concentrations.

In order to counteract the foul odor of decomposing urine, deodorant blocks are commonly placed inside urinals. For many years, deodorant blocks containing paradichlorobenzene and naphthalene were used to counteract odors in rest rooms. However, during the last several decades, it has been observed that exposure to that chemical is responsible for numerous health problems, including kidney and liver disease. Consequently, the use of paradichlorobenzene—particularly around children—has been prohibited in certain jurisdictions. Naphthalene has compiled a record of even greater toxicity than paradichlorobenzene. Other, less toxic aromatic compounds are now being used to combat foul odors in rest rooms.

What is needed is an apparatus that is installable within the collector and flush receptacle a urinal that will not only release a refreshing aroma that counteracts urine odors, but also dispense a controlled amount of chemical compound that interferes with the formation of urine calculus deposits in the urinal and drain pipes of the urinal.

SUMMARY OF THE INVENTION

The present invention provides a multi-function canister mountable within a urinal at the corner of the ceiling and rear wall thereof. The canister is held in place by a spring clip that is insertable in one of the flush apertures in the urinal ceiling. The spring clip biases the apparatus against the rear wall of the urinal, thereby maintaining it in place. As flush apertures near the center of some urinals are not sufficiently deep for insertion of the spring clip, due to their proximity to the central, fresh water inlet pipe, the spring clip is offset to one side of the apparatus so that the apparatus can be centered in the urinal for aesthetic reasons. For urinals having flush apertures that enter the top of the chamber on or about a 45-degree angle, a suction cup structure may be installed on the housing to assist with retention of the canister within the urinal chamber.

The canister continually dispenses an odor counteracting aroma from an onboard fragrance tablet and, with each flush of the urinal, dispenses a controlled amount of a chemical compound that interferes with the formation of urine calculus deposits that installs within the urinal. The canister includes a housing having a reservoir containing the chemical compound in solid form. A deflector tray, which opens to the rear of the canister, is installed above the reservoir and is positioned near the base of the spring clip. Once the canister is installed within a urinal, with each flush, a stream of water exits the flush aperture in which the spring clip is installed and spills onto the deflector tray. A small opening in the deflector tray permits water to enter the reservoir. A layer of standing water in the reservoir slowly dissolves the supply of solid chemical compound and, with each flush, some of this dissolved compound in the standing water layer overflows from the reservoir into the deflector tray, and is expelled against the back wall of the urinal, whence it flows into the urinal bowl. For a currently utilized embodiment of the invention, the solid compound is sulfamic acid. In order to protect the sulfamic acid from moisture after the reservoir is filled and until it is installed, the sulfamic acid is covered with a layer of polyethylene glycol. After installation, the polyethylene glycol is quickly dissolved and the sulfamic acid exposed. The housing of the canister also includes a mounting location for the fragrance tablet. The canister may also include a grill which covers the reservoir and fragrance tablet and provides an attractive, finished appearance to the canister.

DETAILED DESCRIPTION OF THE INVENTION

The invention will now be described with reference to the included drawing figures. It is to be understood that the drawings are not necessarily drawn to scale, and that they are intended to be merely illustrative.

Figure 1:
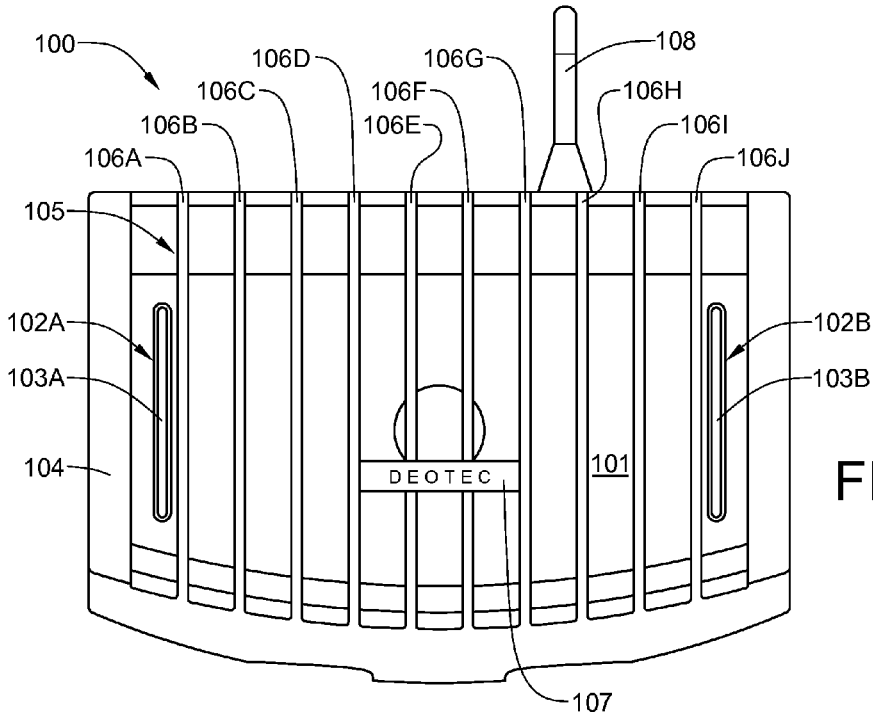
FIG. 1 is a front elevational view of the multi-function urinal canister.

Referring now to the front view of FIG. 1, the multi-purpose canister 100 has a fragrance tablet 101 with two elongated vertical apertures 102A and 102B that enable it to remain suspended on left and right hangers 103A and 103B, respectively. The fragrance tablet 101 is made of porous polymeric material that is impregnated with a volatile aromatic fragrance compound. A front cover 104 having a grill 105 formed from vertical ribs 106A-106J snaps onto the canister housing, which is not visible in this view. A horizontal bar 107 that interconnects vertical ribs 106D, 106E, 106F and 106G provides a convenient space to mount a trademark. A spring clip 108, which protrudes from the housing, is insertable in one of the flush apertures at the top of a urinal chamber. The spring clip 108 biases the canister 100 against the chamber rear wall, thereby maintaining it in place. As flush apertures near the center of some urinals are not sufficiently deep for insertion of the spring clip 108, due to their proximity to the central, fresh water inlet pipe, the spring clip 108 is offset to one side (in this example, to the right) of the canister 100 so that the canister 100 can be centered in the urinal for aesthetic reasons.

Figure 2:
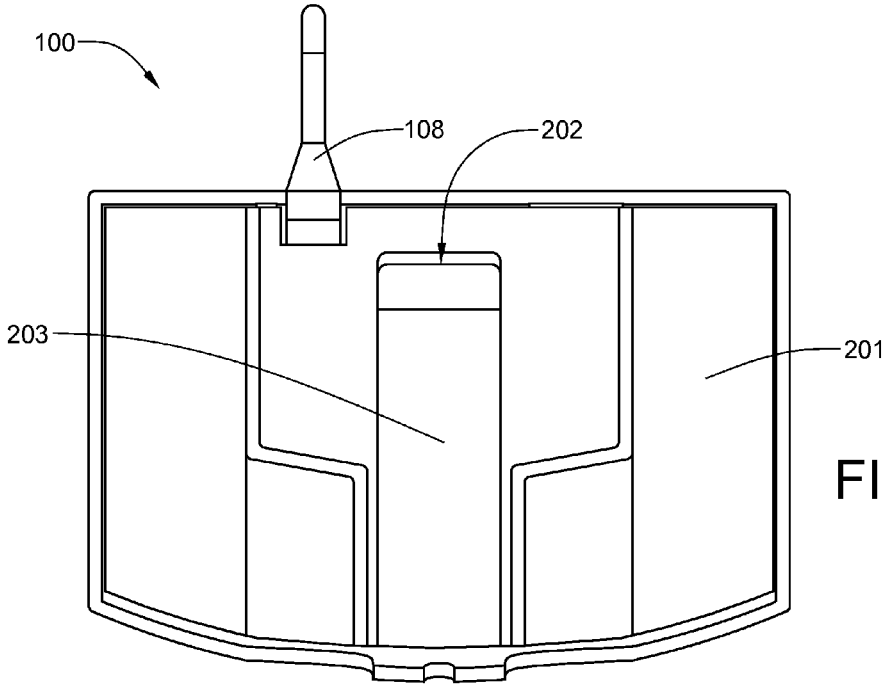
FIG. 2 is a rear elevational view of the multi-function urinal canister.

Referring now to the rear view of FIG. 2, the multi-purpose canister 100 includes a housing 201. The outer edges of the snap-on front cover 104 are visible in this view. When installed in a urinal, that which is seen in this view faces the wall of the urinal chamber. The housing contains a reservoir filled with a water-soluble solid, a portion of which is dispensed with each flush to inhibit potassium phosphate scale formation on the interior surfaces, trap and drain of the urinal. The housing 201 has a central dispensing orifice 202, from which the dissolved compound escapes from the reservoir. The orifice 202 communicates with a vertical channel 203 that directs the water into the urinal chamber. The spring clip 108 is attached to the housing 201.

Figure 3:
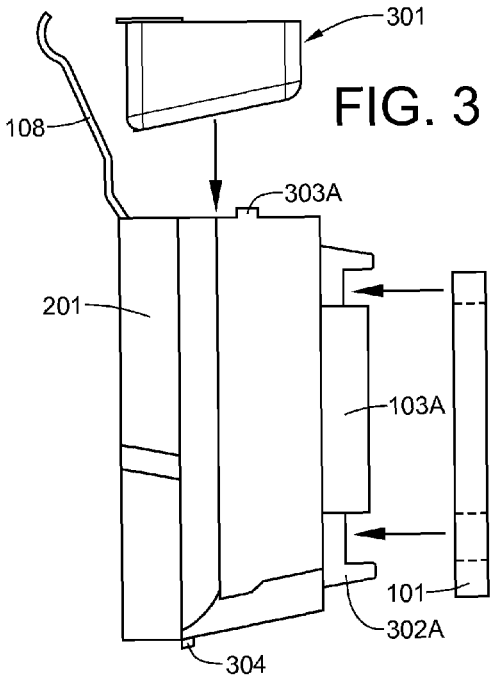
FIG. 3 is an exploded, left-side elevational view of the housing showing the deflector tray positioned above and the fragrance tablet positioned to the right thereof.

Referring now to FIG. 3, this exploded view of the canister 100 shows the deflector tray 301 above the housing 201 and the fragrance tablet 101 to the right of the housing 201. The left tablet hanger 103A is visible in profile, as is a secondary left-side tablet support 302A. A left upper front cover retainer projection 303A is visible, as is a single center lower front cover retainer projection 304. Aligning apertures (not shown in this view) in the front cover 104 snap over the projections 303A, 303B (not shown) and 304, thereby retaining the front cover 104 in place on the housing 201.

Figure 4:
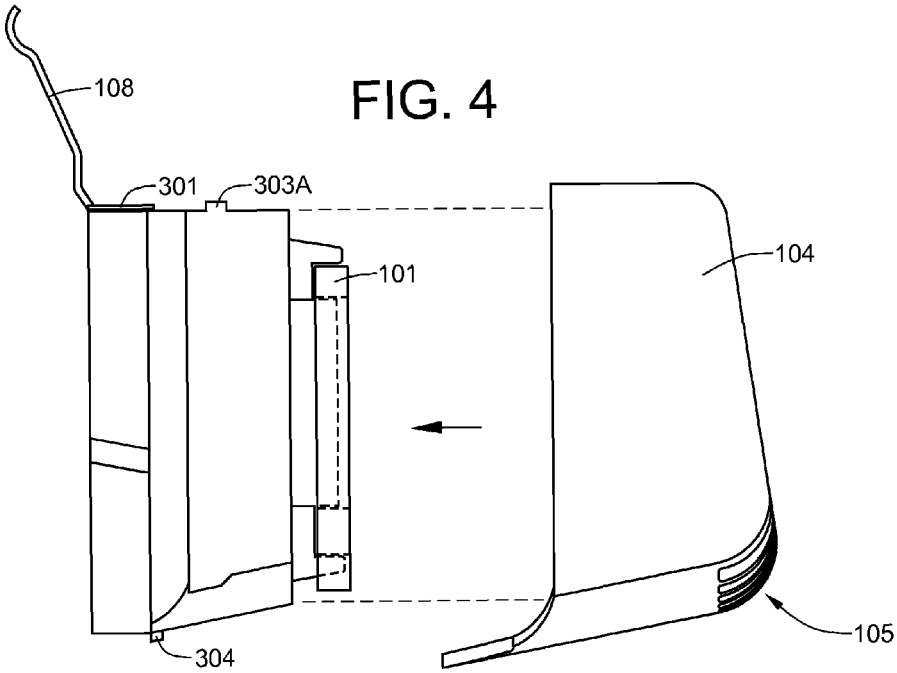
FIG. 4 is an exploded, left-side elevational view of the canister showing the housing assembled with the deflector tray and fragrance tablet, and the grill positioned to the right of the housing.
Figure 6:
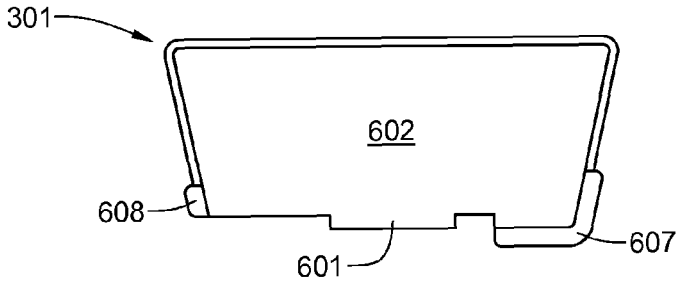
FIG. 6 is a top plan view of the deflector tray.
Figure 7:
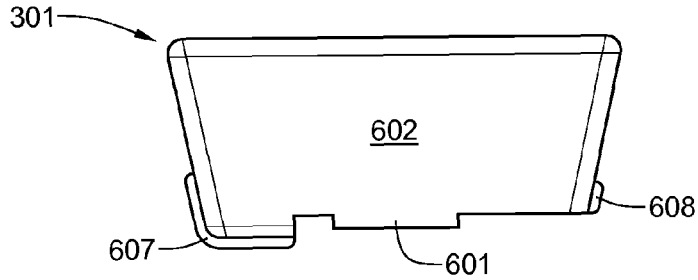
FIG. 7 is a bottom plan view of the deflector tray.
Figure 8:
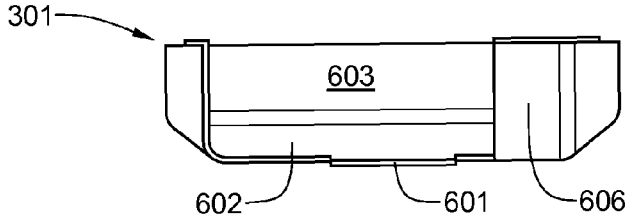
FIG. 8 is a rear elevational view of the deflector tray.
Figure 9:
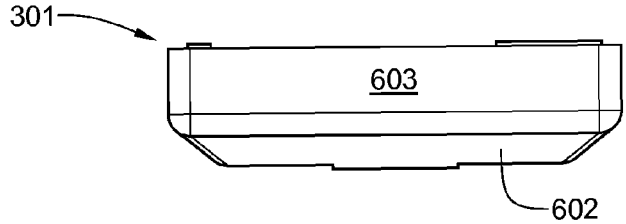
FIG. 9 is a front elevational view of the deflector tray.
Figure 10:
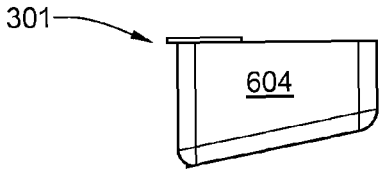
FIG. 10 is a left-side elevational view of the deflector tray.
Figure 11:
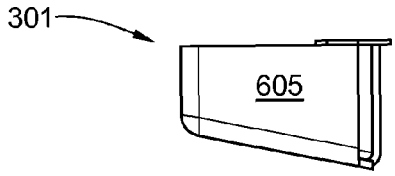
FIG. 11 is a right-side elevational view of the deflector tray.

Referring now to FIG. 4, this left-side view of the canister 100 shows the housing 201 assembled with the deflector tray 301 and fragrance tablet 101, and the front cover 104 positioned to the right of the housing 201.

Figure 5:
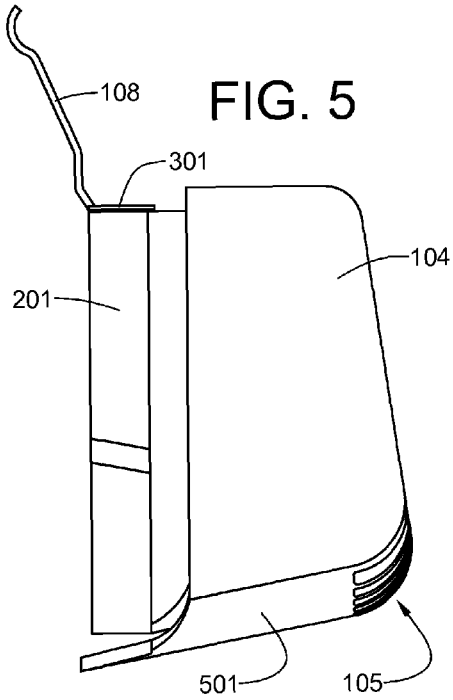
FIG. 5 is a left-side elevational view of the fully-assembled canister.

Referring now to FIG. 5, the canister 100 has been fully assembled. It will be noted that a portion of the housing 201 is exposed when the front cover 104 is installed thereon. It will also be noted that a lower panel 501 of the front cover 104 directs water that may flow over the fragrance tablet 101 to the rear of the canister.

Referring now to FIGS. 6 through 11, the deflector tray 301 is shown from six different angles. It will be noted that the deflector tray 301 has a projecting tab 601 that fits into the central dispensing orifice 202 in the housing 201, resting on the bottom edge thereof. It will also be noted that the deflector tray 301 has a bottom panel 602 that slopes to the rear of the canister, a front wall 603, a left wall 604, a right wall 605, and a partial rear wall 606. As a result of the sloping bottom panel 602 and partial rear wall 606, water that flows into the deflector tray 301 is directed to the central dispensing orifice 202. The deflector tray 301 also has a partial left rear flange 607 and a small right rear flange 608 that rest against the upper edges of the reservoir (not shown in this view) of the housing 201, thereby supporting the deflector tray 301.

Figure 12:
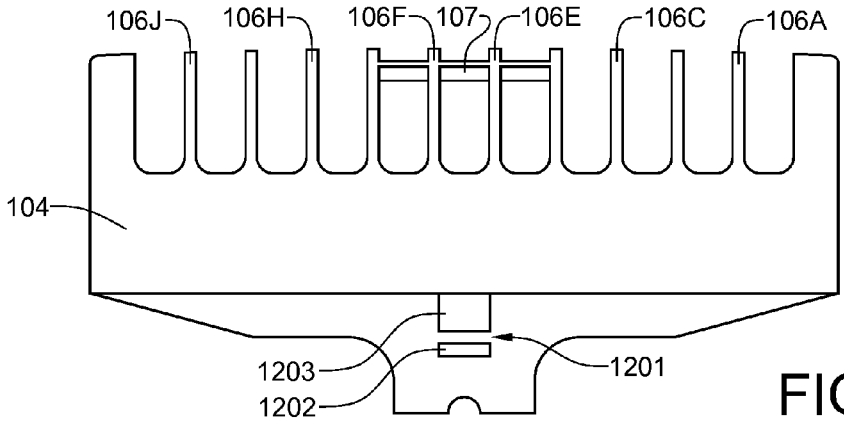
FIG. 12 is a top plan view of the grill.

Referring now to FIG. 12, this top view of the front cover 104 shows the grill 105, ten ribs 106A-106J from which it is formed, and the horizontal bar 107 that interconnects vertical ribs 106D, 106E, 106F and 106G. It will be noted that a gap 1201 between a rear projection 1202 and a front projection 1203 provide a trap for the single center lower front cover retainer projection 304.

Figure 13:
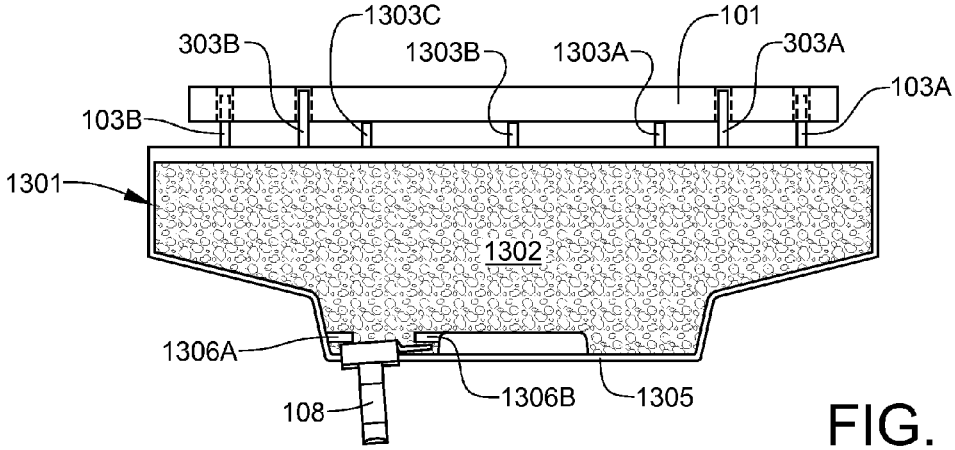
FIG. 13 is a top plan view of the housing with the fragrance tablet installed thereon and the deflector tray removed.

Referring now to FIG. 13, this top view of the housing 201 shows the reservoir 1301 that is filled with the water-soluble solid 1302. It will be noted that the fragrance tablet 101 rests against three standoffs 1303A, 1303B and 1303C, which are integral with the housing 201. It will also be noted that the spring clip 108 is fixedly maintained between two vertical grooves formed by the rear wall 1305 of the housing 201 and first and second vertical strips 1306A and 1306B, which are integral with the housing 201. For a currently utilized embodiment of the invention, the solid compound is sulfamic acid. In order to protect the sulfamic acid from moisture after the reservoir 1301 is filled and until it is installed, the sulfamic acid is covered with a layer of polyethylene glycol. After installation, the polyethylene glycol is quickly dissolved and the sulfamic acid exposed.

Figure 14:
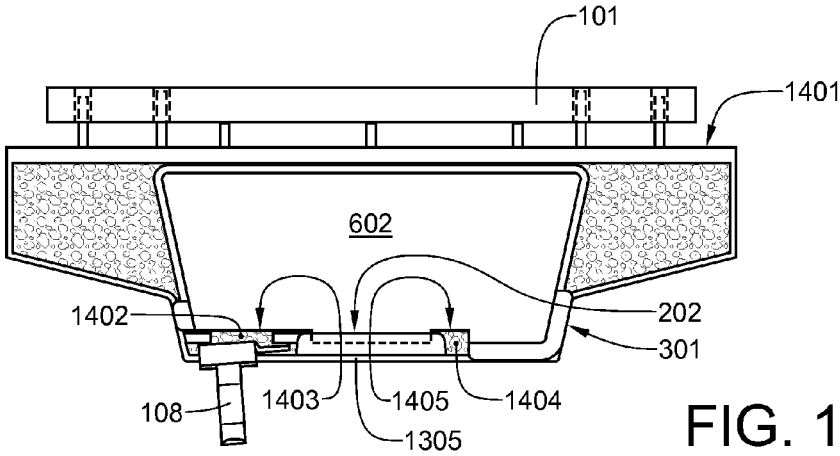
FIG. 14 is a top plan view of the housing with both the fragrance tablet and deflector tray installed thereon.

Referring now to FIG. 14, it will be noted that the three standoffs identified in FIG. 13 maintain the fragrance tablet 101 a distance from the front surface 1401 of the housing 201 for more effective fragrance dissipation. In this view, the deflector tray 301 has been installed above the reservoir 1301. A portion of the water that escapes from the flush aperture in which the spring clip 108 is installed will enter the opening 1402 between the spring clip 108 and the right rear edge 1403 (looking from the front of the canister) of the bottom panel 602 of the deflector tray 301. After several flushed, the water-soluble solid 1302 in the reservoir 1301 will be covered with water up to the level of the rear portion of the deflector tray 301. Therefore water entering the opening 1402 will enter the reservoir 1301 and water containing a portion of the dissolved water-soluble solid 1302 will be expelled from the opening 1404 formed by the left rear edge 1405 of the bottom panel 602 and the rear wall 1305 of the housing 201. The expelled water will then flow out the central dispensing orifice 202, down the vertical channel 203 into the urinal chamber.

Figure 15:
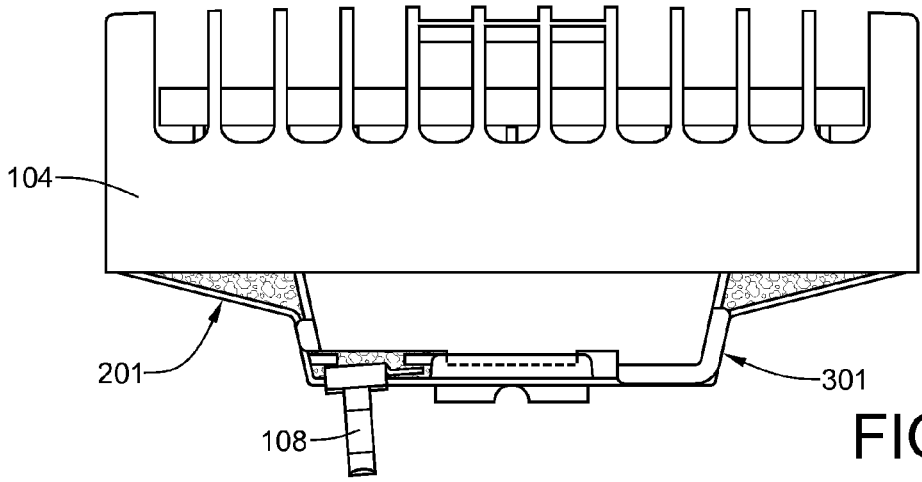
FIG. 15 is a top plan view of the fully-assembled canister.

Referring now to FIG. 15, the front cover 104 has been installed on the housing 201. It will be noted that a rear portion of the deflector tray 301 is exposed.

Figure 16:
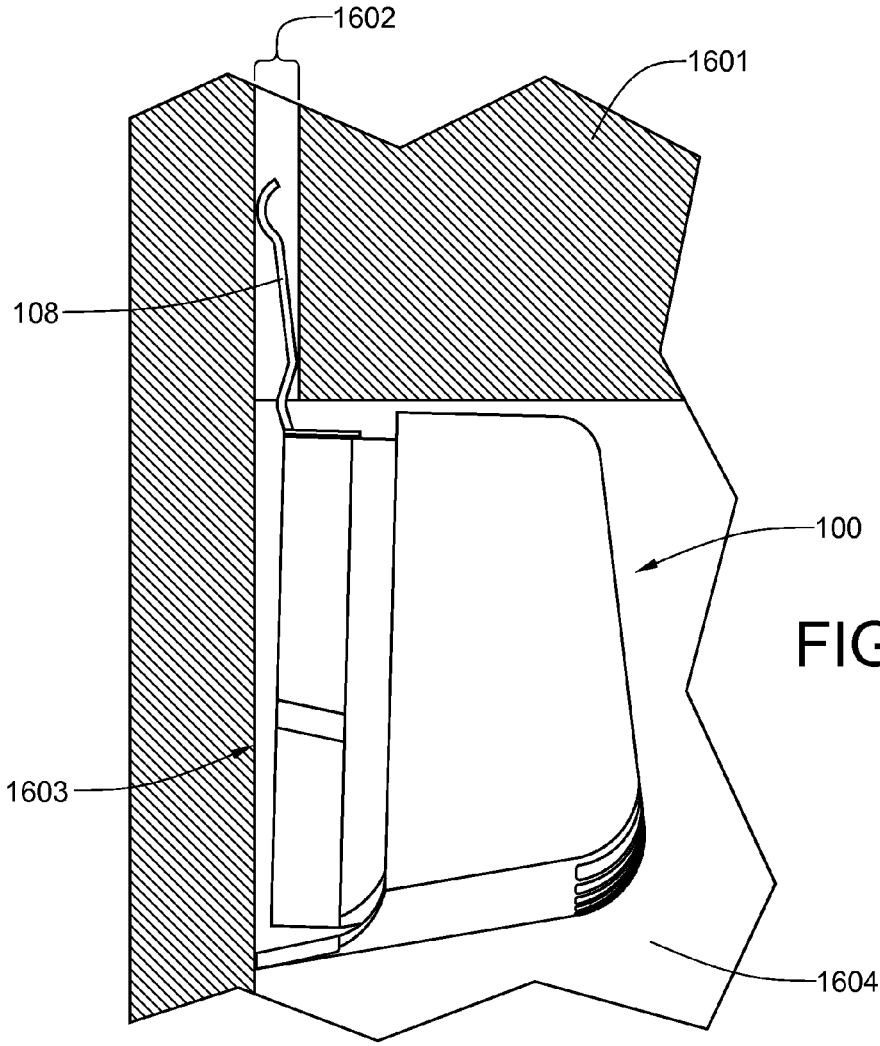
FIG. 16 is a cross-sectional view of a urinal, taken through a flush aperture, and showing the spring clip of a canister installed therein.

Referring now to FIG. 16, this cross-sectional view of a urinal 1601, taken through a flush aperture 1602, shows the spring clip 108 of a canister 100 installed therein. Flexing of the spring clip 108 biases the canister 100 against the rear wall 1603 of the urinal chamber 1604.

Figure 17:
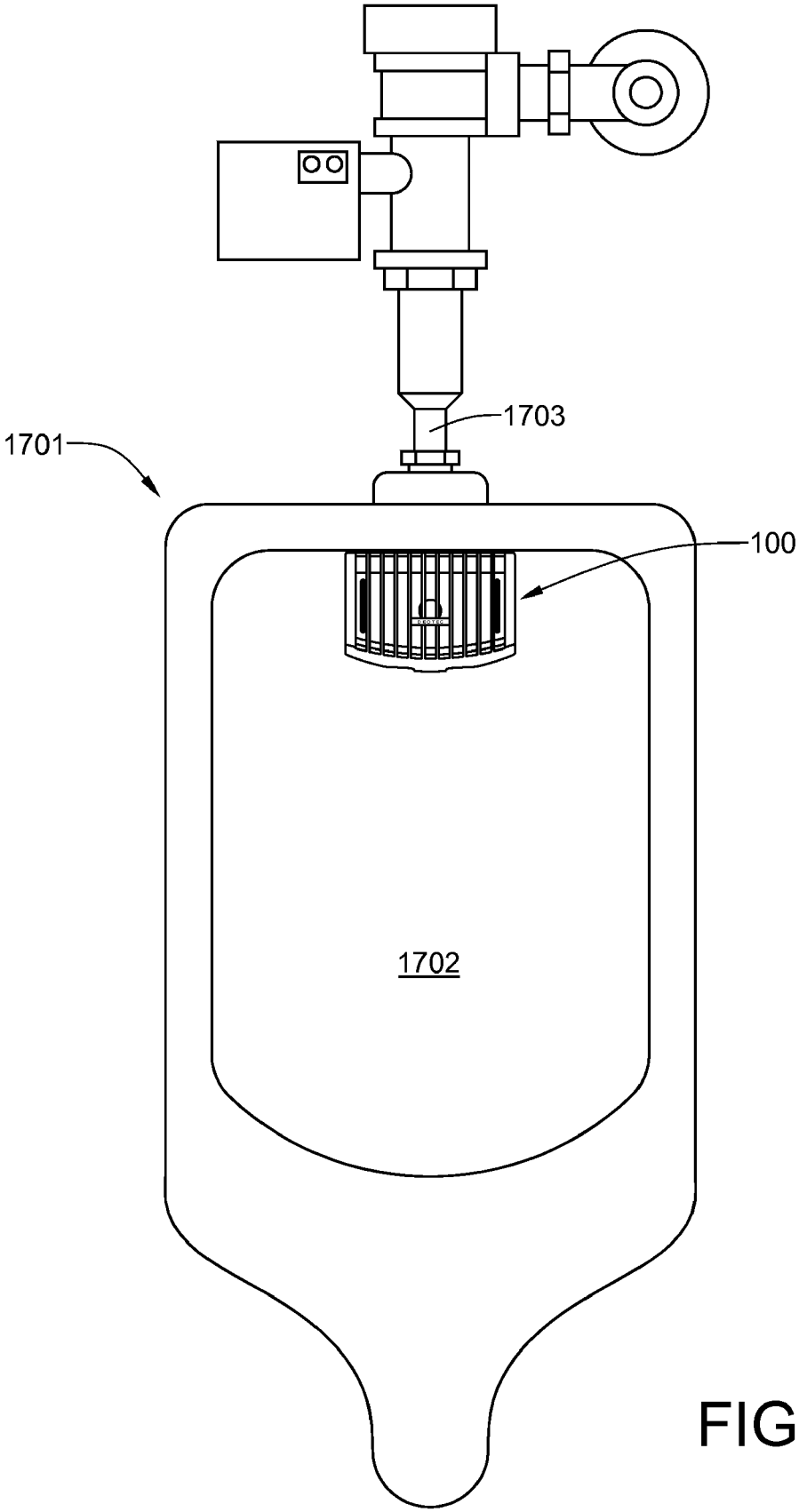
FIG. 17 is a front elevational view of a conventional, modern, auto-flush urinal in which a canister has been installed.

Referring now to FIG. 17, a multi-purpose canister 100 has been installed in this conventional, modern, auto-flush urinal 1701. It will be noted that, as the canister 100 is centered in the urinal chamber 1702, the clip 108 was necessarily inserted in a flush aperture 1602 that was offset from the center of the urinal chamber 1702. As flush apertures near the center of some urinals are not sufficiently deep for full insertion of the spring clip 108, due to their proximity to the central, fresh water inlet pipe 1703, the spring clip 108 is offset to one side so that the canister 100 can be centered in the urinal chamber 1702 for aesthetic reasons.

Unfortunately, there is a lack of standardization in the urinal manufacturing industry. Some urinals, for example, have flush apertures that enter the top of the chamber on a 45-degree angle. Such a design makes it difficult to bias the canister 100 against the rear wall of the urinal with the spring clip 108. For this reason, a supplementary method must be used to secure the canister 100 within the urinal chamber. This supplementary method is shown and described with reference to drawing FIGS. 18 to 21.

Figure 18:
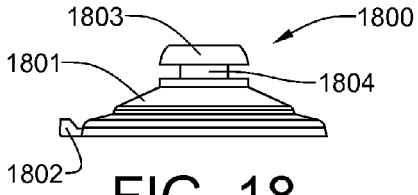
FIG. 18 is an elevational view of a suction cup.
Figure 19:
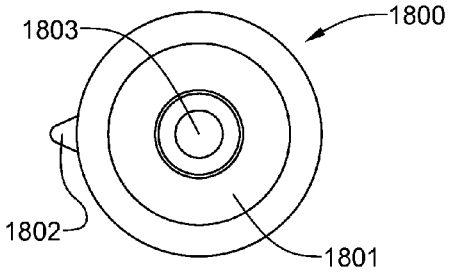
FIG. 19 is a top plan view of a suction cup.
Figure 21:
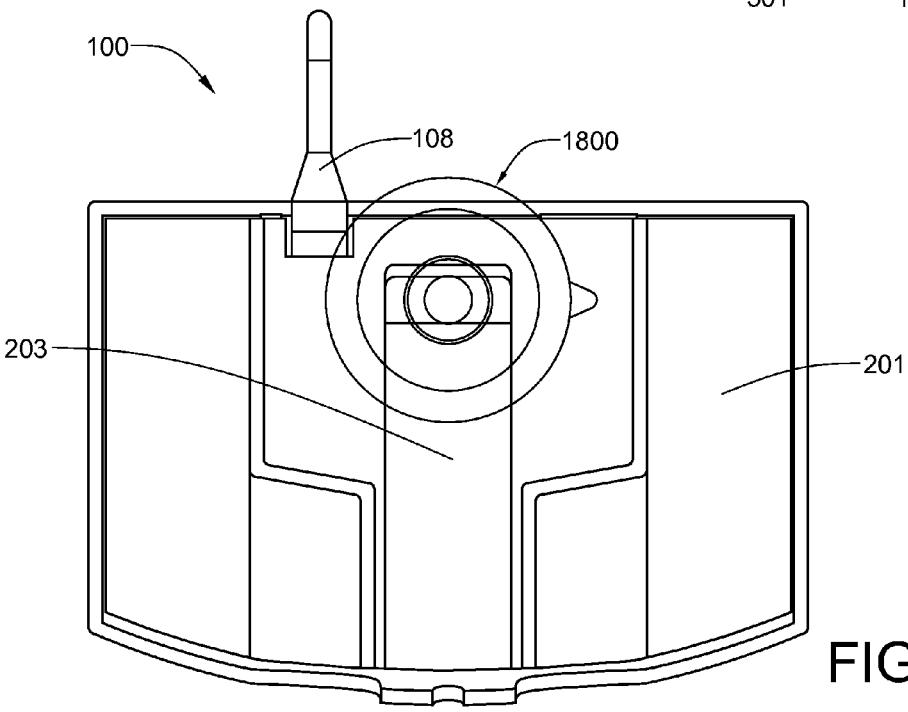
FIG. 21 is a rear elevational view of the fully-assembled canister on which is installed the suction cup of FIGS. 18 and 19.

Referring now to FIGS. 18 and 19, an injection molded suction cup structure 1800 has a cup portion 1801, a release tap 1802 continuous with the cup portion 1801, and an attachment plug portion having a cap 1803 and a shank 1804. Suction cups of this type are typically injection molded from transparent vinyl material. In FIG. 21, the suction cup structure 1800 is shown as having been molded from transparent material.

Figure 20:
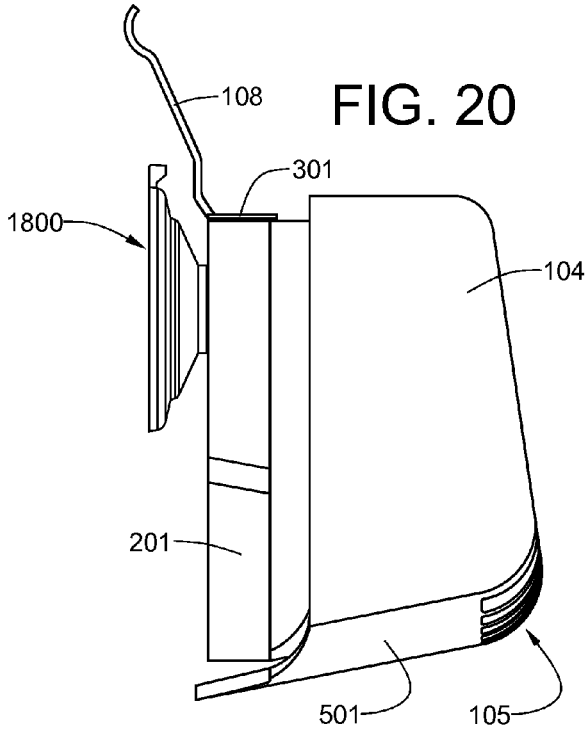
FIG. 20 is a slide elevational view of the fully-assembled canister on which is installed the suction cup of FIGS. 18 and 19.

Referring now to FIGS. 20 and 21, the suction cup structure 1800 of FIGS. 18 and 19 has been installed within the central dispensing orifice 202 of the housing 201. For installation within a urinal chamber having 45-degree-angled flush apertures, the spring clip 108 can be bent backwards to about a 90 degree angle, inserted within one of the flush apertures, and the suction cup structure can be used to assist retention of the canister 100 within the urinal chamber.

Although only a single embodiment of the invention has been shown and described, it will be obvious to those having ordinary skill in the art that changes may be made thereto without departing from the scope and spirit of the invention as claimed.

What is claimed is:

1. A multi-function canister, mountable within a flushable urinal chamber, the chamber having a rear wall, flush apertures for water release in an uppermost portion thereof, and a drain coupled to drainage pipes, said canister comprising:

a fragrance tablet that emits an odor-counteracting aroma, said fragrance tablet having at least one aperture therein;

a housing having at least one generally horizontal projection on a front portion of said housing which engages said at least one aperture in said fragrance tablet;

a reservoir filled with a solid compound, a dissolved portion of which is released into the chamber with water from each flush to inhibit formation of potassium phosphate scale on the surfaces of the urinal chamber and drainage pipes; and a spring clip that is rigidly affixed to said housing and extending in a generally upward direction from said reservoir, said clip being insertable in one of the flush apertures, said clip acting to bias the canister against the rear wall so that the canister remains immovably affixed thereto and with the canister positioned so that said one flush aperture discharges into said reservoir during each flush.

2. The multi-function canister of claim 1, wherein said compound comprises sulfamic acid.

3. The multi-function canister of claim 1, which further comprises a deflector tray which partially covers said reservoir and limits an amount of water which flows into said reservoir during each flush.

4. The multi-function canister of claim 1, which further comprises a front cover having a grill which covers said fragrance tablet and which attaches to said housing.

5. The multi-function canister of claim 1, wherein said spring clip extends primarily in a generally upward direction, but also extends rearwardly somewhat so as to provide a biasing force to said canister.

6. The multi-function canister of claim 1, wherein said spring clip is positioned to one side of center of said housing.

7. A multi-function canister, mountable within a flushable urinal chamber, the chamber having a rear wall, flush apertures for water release in an uppermost portion thereof, and a drain coupled to drainage pipes, said canister comprising:

a fragrance tablet that emits an odor-counteracting aroma over an expected usable life of of said canister, said tablet having a pair of securing apertures therein;

a housing having a pair of generally horizontal projections which engage the securing apertures and a reservoir filled with a solid compound, a dissolved portion of which is released into the chamber with water from each flush to inhibit formation of potassium phosphate scale on the surfaces of the urinal chamber and drainage pipes; and a spring clip that is rigidly affixed to said housing and extending in a primarily upward and in a secondarily rearward direction from said reservoir, said clip being insertable in one of the flush apertures, said clip acting to bias the canister against the rear wall so that the canister remains immovably affixed thereto and with the canister positioned so that said one flush aperture discharges into said reservoir during each flush.

8. The multi-function canister of claim 7, wherein said compound comprises sulfamic acid.

9. The multi-function canister of claim 7, which further comprises a deflector tray which partially covers said reservoir and limits an amount of water which flows into said reservoir during each flush.

10. The multi-function canister of claim 7, which further comprises a front cover having a grill which covers said fragrance tablet and which attaches to said housing.

11. The multi-function canister of claim 7, wherein said spring clip is positioned to one side of center of said housing.

12. A canister, mountable within a flushable urinal chamber having a rear wall, flush apertures for water release in an uppermost portion thereof, and a drain coupled to drainage pipes, the canister comprising:

a housing having a reservoir filled with a solid compound, a dissolved portion of which is released into the chamber with water from each flush to inhibit formation of potassium phosphate scale on the surfaces of the urinal chamber and drainage pipes, said housing also having at least one generally horizontal projection on a front portion thereof;

a fragrance tablet that emits an odor-counteracting aroma, said fragrance tablet having at least one aperture therein which engages said at least one projection on the front portion of said body; and a spring clip that is rigidly affixed to said housing and extending in a generally upward direction from said reservoir, said clip being insertable in one of the flush apertures, said clip being rearwardly bendable so as to bias the canister against the rear wall so that the canister remains immovably affixed thereto and with the canister positioned so that said one flush aperture discharges into said reservoir during each flush.

13. The canister of claim 12, wherein said compound comprises sulfamic acid.

14. The canister of claim 12, which further comprises a deflector tray which partially covers said reservoir and limits an amount of water which flows into said reservoir during each flush.

15. The canister of claim 12, which further comprises a suction cup attached to a rear portion of the housing, said suction cup assisting in the retention of the canister within the urinal chamber.

16. The canister of claim 12, which further comprises a front cover having a grill which covers said fragrance tablet and which attaches to said housing.

17. The multi-function canister of claim 12, wherein said spring clip is positioned to one side of center of said housing.

* * * * *